US008602809B2

(12) United States Patent
Kyoyama

(10) Patent No.: US 8,602,809 B2
(45) Date of Patent: Dec. 10, 2013

(54) LOCKING COVER FOR ELECTRICAL CONNECTION APPLIANCE

(75) Inventor: Takashi Kyoyama, Moriguchi (JP)

(73) Assignee: Nifco Inc., Yokohama-Shi (JP)

( * ) Notice: Subject to any disclaimer, the term of this patent is extended or adjusted under 35 U.S.C. 154(b) by 0 days.

(21) Appl. No.: 13/518,168

(22) PCT Filed: Dec. 17, 2010

(86) PCT No.: PCT/JP2010/007342

§ 371 (c)(1),
(2), (4) Date: Jul. 30, 2012

(87) PCT Pub. No.: WO2011/077685

PCT Pub. Date: Jun. 30, 2011

(65) Prior Publication Data

US 2012/0302085 A1 Nov. 29, 2012

(30) Foreign Application Priority Data

Dec. 25, 2009 (JP) ..... 2009-294523

(51) Int. Cl.
*H01R 13/627* (2006.01)

(52) U.S. Cl.
USPC ..... 439/358

(58) Field of Classification Search
USPC ..... 439/357, 350, 358, 581, 892
See application file for complete search history.

(56) References Cited

U.S. PATENT DOCUMENTS 5,634,809 A * 6/1997 Hirai ..... 439/352
7,081,002 B2 * 7/2006 de Vanssay et al. ..... 439/350
7,150,634 B2 * 12/2006 Kamata et al. ..... 439/95

* cited by examiner

*Primary Examiner* — Neil Abrams
*Assistant Examiner* — Travis Chambers
(74) *Attorney, Agent, or Firm* — Manabu Kanesaka

(57) ABSTRACT

A locking cover for an electrical connecting appliance, to be mounted on a second electrical connecting appliance connected to a first electrical connecting appliance, for preventing a disconnection between the first electrical connecting appliance and the second electrical connecting appliance. The locking cover includes a cover main body externally fitted onto the second electrical connecting appliance, first locking pieces formed on the cover main body, and second locking pieces formed on the cover main body. The first locking pieces elastically engages first appliance side locking portions, and release an elastic engagement by receiving an external force to an engagement releasing position. The second locking pieces elastically disengageably engage second appliance side locking portions provided on the second electrical connecting appliance. The second locking pieces are pressed by the first locking pieces displaced to the engagement releasing position to restrict releasing an engagement with the second appliance side locking portions.

6 Claims, 7 Drawing Sheets

LOCKING COVER FOR ELECTRICAL CONNECTION APPLIANCE

RELATED APPLICATIONS

The present application is National Phase of International Application No. PCT/JP2010/007342 filed Dec. 17, 2010, and claims priority from Japanese Application No. 2009-294523, filed Dec. 25, 2009

FIELD OF TECHNOLOGY

The present invention relates to a locking cover for an electrical connection appliance for maintaining a connected state of the electrical connecting appliance.

BACKGROUND ART

Conventionally, in an electrical appliance and the like, an electricity supply or the sending and receiving of an electrical signal is carried out through a cord, a cable, and the like, and for the aforementioned connections, the electrical connecting appliance comprising a plug, a socket, a connector and the like, is used. In this kind of electrical connecting appliance, if the connection thereof is loosened because the cord, the cable, and the like are pulled and the like for some reason, the connection between terminals is disconnected, or a contact failure and the like occur so as to have a possibility to cause trouble.

Therefore, there exists a conventional technology for maintaining the connected state of such electrical connecting appliance. For example, there is well-known a lock structure of a cord retaining apparatus comprising a clamper and a holder mutually connected, and while the clamper comprises an elastic engaging piece provided on a side wall of a main body of the clamper, and including an engaging portion on a front side which becomes a connecting side relative to the holder, the holder comprises a corresponding engaging portion engaging with the engaging portion of the clamper. Also, the elastic engaging piece of the clamper is connected to a support piece extending from the side wall of the clamper main body so as to be integrally formed with the clamper main body, and also the support piece extends in a direction of inclining to the front side from the side wall of the clamper main body (see Patent Document 1).

PRIOR ART DOCUMENT

Patent Document

Patent Document 1: Japanese Unexamined Patent Publication No. 2004-353378

SUMMARY OF THE INVENTION

Problems to be Solved by the Invention

In the conventional technology described in the aforementioned Patent Document 1, however, in the clamper, in order to stably hold the socket (a cord end portion), there is provided a convex engaging wall corresponding to an outer shape of the socket on an inner wall of the clamper. However, especially, when a lock is released (i.e., the clamper is removed from the holder), a force acts in a direction wherein the clamper is disengaged from the socket, so that in a case wherein there is variability in the outer shape of the socket used, there has been a problem that the clamper comes off from the socket, so that a user is required to mount the clamper again.

Also, in the aforementioned conventional technology, since the locking wall of the clamper has a structure which is hard to be deformed, it has been necessary to constitute the clamper by a pair of half divided members, and to assemble the half divided members in a state wherein the socket is mounted internally. Therefore, there have been problems that the number of components increases, and also that a load of an assembling operation increases.

The present invention is made in view of the problems of such conventional technology, and an object of the present invention is to provide a locking cover for an electrical connecting appliance which can prevent a disengagement from the electrical connecting appliance when the lock is released, while maintaining a high durability and a lock force relative to repeated use.

Means for Solving the Problems

In order to solve the aforementioned problems, the first invention is a locking cover (5) mounted on a second electrical connecting appliance (4) connected to a first electrical connecting appliance (7), and preventing a disconnection between the first electrical connecting appliance and the second electrical connecting appliance. The first invention has a structure in which the locking cover (5) includes a cover main body (21) externally fitted into the second electrical connecting appliance; a first locking piece (23) formed in the cover main body, elastically engaging with a first appliance side locking portion (34) provided on the first electrical connecting appliance side, and also being displaced to an engagement releasing position by receiving an external force so as to release the elastic engagement; and a second locking piece (24) formed in the cover main body, and elastically disengageably engaging with a second appliance side locking portion (11) provided on the second electrical connecting appliance side. Also, the second locking piece is pressed by the first locking piece which has been displaced to the engagement releasing position so as to restrict a displacement in a direction wherein an engagement with the second appliance side locking portion is released.

Also, a second invention can have a structure in which the first locking piece is supported in a hinge portion (33) extending from a side wall (22) of the cover main body, and also is displaced by the hinge portion as a supporting point, and in which the second locking piece is formed as one portion of the side wall facing the first locking piece.

Also, a third invention can have a structure in which one of the first or the second locking piece includes a pressing projection (35) abutting against the other of the first or the second locking piece when the first locking piece is displaced to the engagement releasing position.

Also, a fourth invention can have a structure of including fixing means (61 and 71) interposed in a gap between the cover main body and the second electrical connecting appliance.

Also, a fifth invention can have a structure in which the fixing means comprise an elastic member (61) abutting against an inner surface of the cover main body and an outer surface of the second electrical connecting appliance.

Also, a sixth invention can have a structure in which the fixing means comprise a wedge-like member (71) abutting against the inner surface of the cover main body and the outer surface of the second electrical connecting appliance, and also being capable of changing an abutting position thereof.

Effect of the Invention

According to the first invention, there provides an excellent effect to be capable of preventing a disengagement from the second electrical connecting appliance when a lock is released (i.e., the elastic engagement between the first locking piece and the first appliance side locking portion is released) while maintaining a high durability and a lock force relative to repeated use.

Also, according to the second invention, due to a simple structure which can integrally form the cover main body, and the first and the second locking pieces, the disengagement from the electrical connecting appliance when the lock is released can be prevented while maintaining the high durability and the high lock force relative to the repeated use.

Also, according to the third invention, due to the pressing projection, an intended portion in the second locking piece can be pressed by an appropriate force so as to be capable of preventing the disengagement from the electrical connecting appliance when the lock is released more reliably.

Also, according to the fourth invention, even in a case wherein there is variability in a size of the second electrical connecting appliance, the wobbling of the locking cover and the second electrical connecting appliance is prevented so as to be capable of preventing the disengagement from the electrical connecting appliance when the lock is released further reliably.

Also, according to the fifth invention, due to the simple structure, the wobbling of the locking cover and the second electrical connecting appliance can be prevented.

Also, according to the sixth invention, an allowable range relative to the variability in the size of the second electrical connecting appliance increases so as to be capable of preventing the wobbling of the locking cover and the second electrical connecting appliance further effectively.

BEST MODES OF CARRYING OUT THE INVENTION

Hereinafter, with reference to drawings, a cord retaining apparatus as a locking cover for an electrical connecting appliance according to the present invention will be explained. In an explanation, directional terms correspond to directions shown by arrows in FIG. 1.

<First Embodiment>

Figure 1:
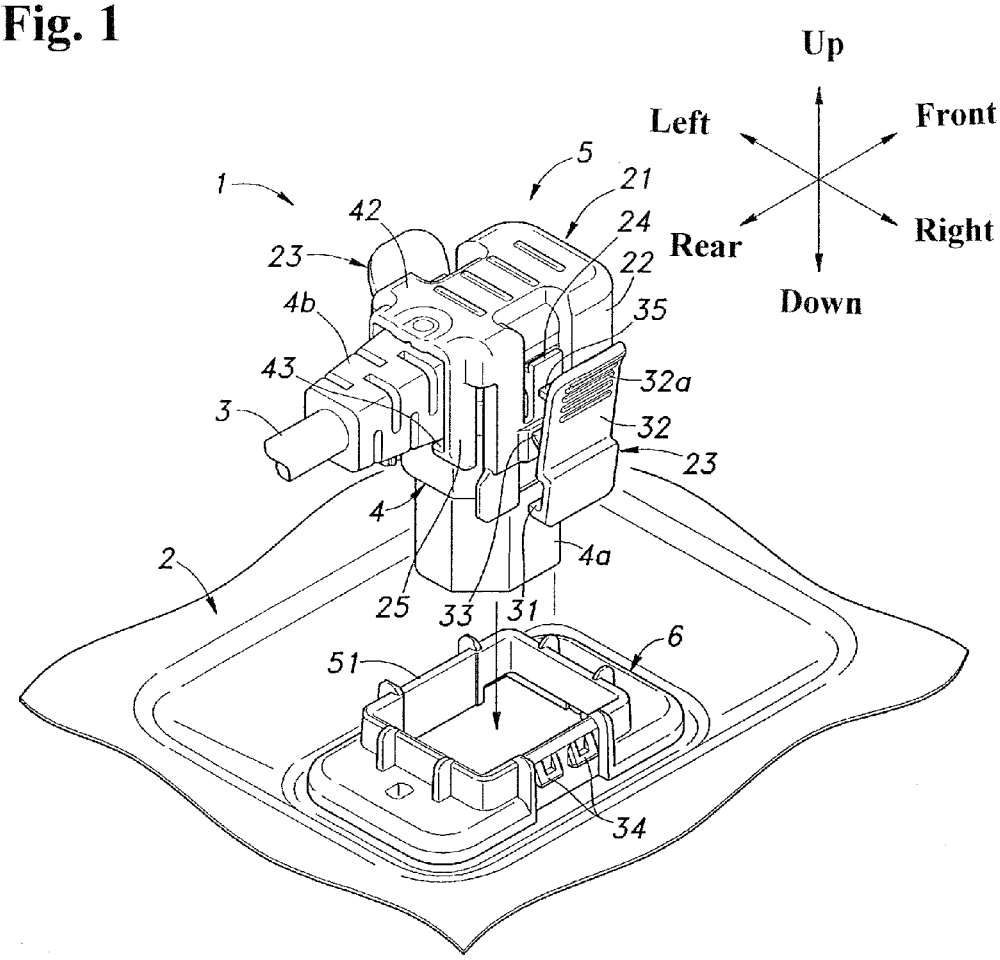
FIG. 1 is a perspective view of a cord retaining apparatus comprising a locking cover according to the first embodiment.

As shown in FIG. 1, a cord retaining apparatus 1 according to the first embodiment is for stably maintaining a connected state of an AC power-supply cord 3 connected for supplying electricity to a power supply portion 2 provided in an electrical appliance and the like. The cord retaining apparatus 1 comprises a plastic locking cover (hereinafter, simply called as a cover) 5 attached to a female socket 4 provided in an end portion of the AC power-supply cord 3, and a plastic holder 6 in which the cover 5 is detachably connected. In a state wherein an end portion 4*a* of the female socket 4 is inserted into a male socket 7 (see FIGS. 4(A) and 4(B)) on a receiving side provided in the power supply portion 2, the locking cover 5 is locked in the holder 6, so that the cord retaining apparatus 1 can retain the AC power-supply cord 3 from the power supply portion 2.

Figure 2:
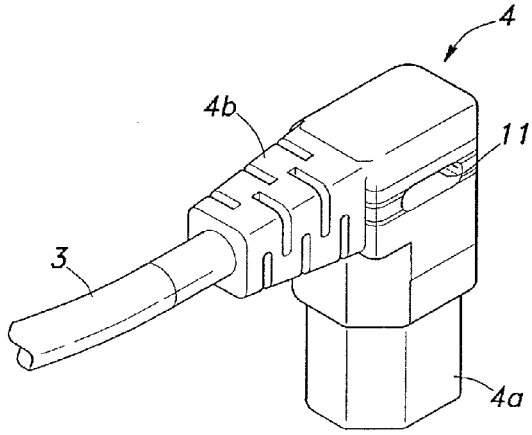
FIG. 2 is a perspective view of an AC power-supply cord comprising a female socket.

As shown in FIG. 2, the female socket 4 is an L-shaped socket bent at an approximately right angle, and includes a metal terminal (not shown in the figures) in an inside thereof roughly in the same manner as a heretofore known socket. On right and left side portions of the female socket 4, there are formed grooves 11 served for a locking of the locking cover 5. Also, the male socket 7 shown in FIGS. 4(A) and 4(B) has a structure corresponding to the female socket 4, and includes a metal terminal (not shown in the figures) electrically connected to the metal terminal of the female socket 4 in an inside thereof.

Figure 3:
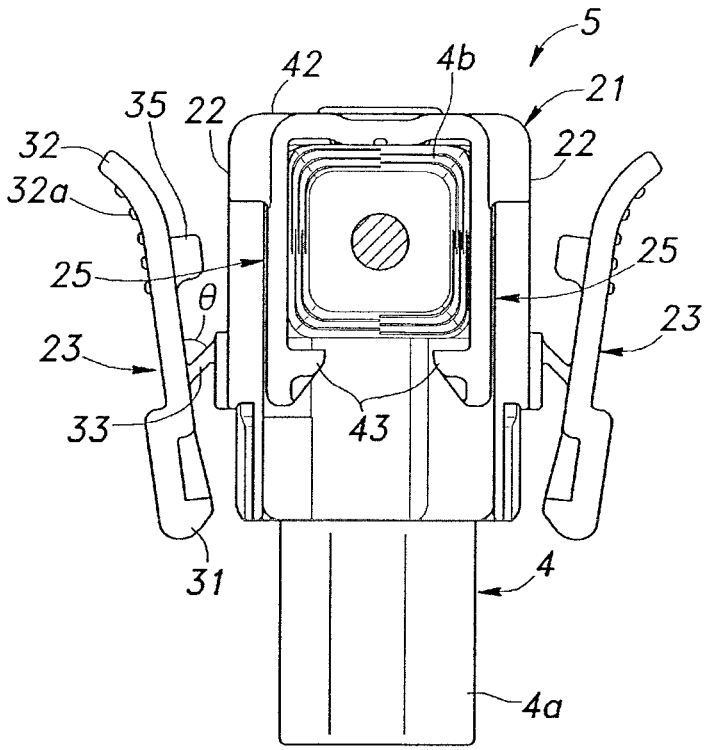
FIG. 3 is a rear view showing the locking cover in a state wherein the female socket is held.

The cover 5 has a symmetrical shape, and as shown in FIGS. 1 and 3, the cover 5 includes an approximately cubic cover main body 21 whose back portion and lower portion are open to be externally fitted into the female socket 4. In the cover main body 21, there are integrally formed a pair of locking levers 23 disposed outside right and left side walls 22, and elastically engaging with the holder 6; and a pair of locking walls 24 formed as one portion of the right and left side walls 22, and elastically engaging, disengageably, with the female socket 4. Moreover, in a back edge portion of the right and left side walls 22 dividing an opening of the back portion of the cover main body 21, there is provided a pair of locking bars 25 elastically engaging with a base end portion 4*b* of the female socket 4.

The locking levers 23 and 23 extend in an up-and-down direction (a connecting direction between the cover 5 and the holder 6), and include claw portions 31 as engaging portions provided on a lower side thereof (a holder 6 side); and knob portions 32 provided on an upper side thereof, and served for an operation of a user. The locking levers 23 and 23 are integrally formed with the cover main body 21. Also, in the locking levers 23 and 23, intermediate portions in the up-and-down direction thereof are respectively connected to the right and left side walls 22 of the cover main body 21 through support pieces 33. Thereby, when the locking levers 23 and 23 receive an operational force (an external force) of a user, the locking levers 23 and 23 can tilt as a supporting point of the support pieces 33.

Figure 4:
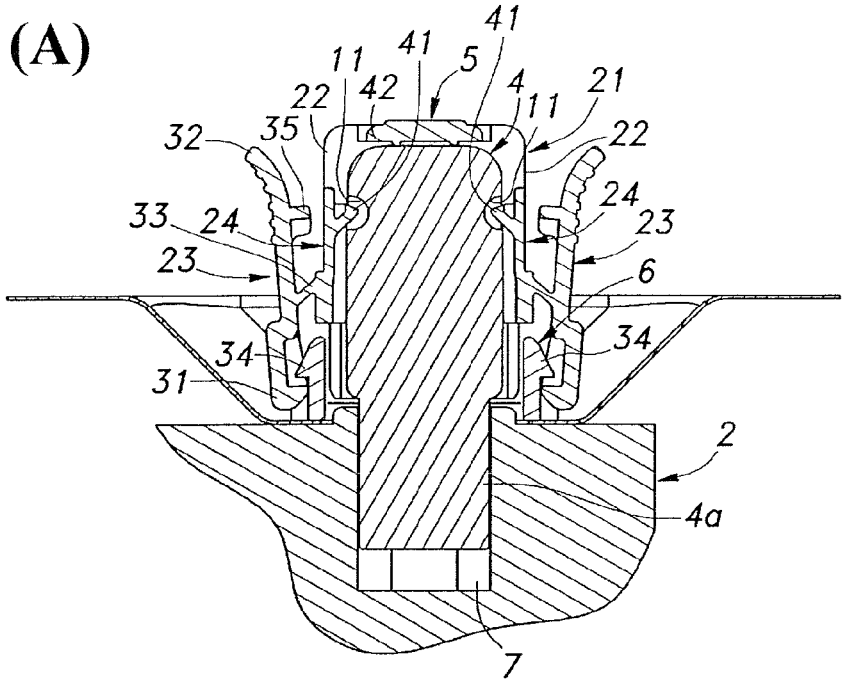
FIG. 4(A) is a cross-sectional view showing a lock state of the cord retaining apparatus.
FIG. 4(B) is a cross-sectional view showing an unlock start state of the cord retaining apparatus.
Figure 4:
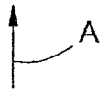
Figure 4:
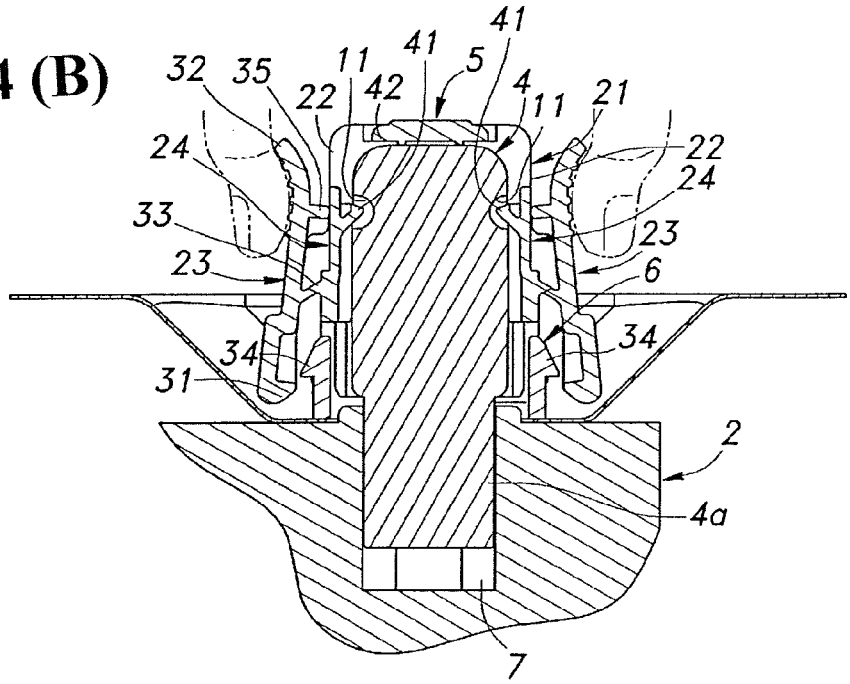

The claw portions 31 are provided to protrude toward the side walls 22 from ends of the locking levers 23 and 23, and when the cover 5 is connected to the holder 6, the claw portions elastically engage with right and left claw receiving portions 34 (see FIGS. 1, 4(A), and 4(B)) provided as corresponding engaging portions on the holder 6 side.

In the knob portions 32, there is provided a plurality of non-slip convex portions 32*a* on a surface (an outer surface) wherein a user presses with the fingers at a time of the operation. Also, although the details are described hereinafter, inside the knob portions 32 (side walls 22 side), there are provided pressing projections 35 served for preventing the cover from being disengaged from the female socket 4 when a connection between the cover 5 and the holder 6 is released.

As shown in FIG. 3, the support pieces 33 have a shape which can be easily elastically deformed, and extend in a direction of inclining to a lower side (claw portions 31 side) from the right and left side walls 22. Preferably, an inclining angle θ of the support pieces 33 is approximately 45°. Due to an inclination of the support pieces 33, when the locking and the release of the claw portions 31 relative to the claw receiving portions 34 are carried out, a bending amount of the support pieces 33 which elastically deform is decreased. Also, a force which acts on the support pieces 33 is dispersed so as to reduce a load, so that a deformation or breakage of the support pieces 33 can be prevented more appropriately.

As shown in FIGS. 4(A) and 4(B), the locking walls 24 and 24 are elastic pieces formed in a central portion of the side walls 22 in a cantilever shape as fixed ends of a lower end side thereof. Inside the locking walls 24 and 24, locking claws 41 as engaging portions with the female socket 4 are provided to protrude toward a female socket 4 side. In the locking walls 24 and 24, due to an elastic deformation thereof, end sides wherein the locking claws 41 are provided expand and open so as to be capable of receiving the female socket 4. The locking claws 41 are disposed corresponding to the grooves 11 of the female socket 4, and when the female socket 4 is received inside the cover 5, the locking claws 41 come to a state of being fitted into the grooves 11 thereof.

As shown in FIG. 1, the locking bars 25 and 25 are provided to extend downward from an upper wall 42 side of the cover 5, and on an end thereof, there are provided to inwardly protrude locking claws 43 as engaging portions with the female socket 4. In the locking bars 25 and 25, due to the elastic deformation thereof, end sides wherein the locking claws 43 are provided expand and open so as to be capable of receiving the base end portion 4*b* of the female socket 4. Also, as shown in FIG. 3, in a state wherein the cover 5 is attached to the female socket 4, an upper surface and right and left side surfaces of the base end portion 4*b* of the female socket 4 are externally surrounded by the upper wall 42 of the cover 5 and main bodies of the locking bars 25 and 25, and also a lower surface of the base end portion 4*b* is locked by both locking claws 43. Thereby, a disengagement of the base end portion 4*b* of the cover 5 from the female socket 4 is prevented.

As shown in FIG. 1, the holder 6 has a symmetrical shape, and includes a circumferential wall 51 dividing an opening wherein the female socket 4 is inserted. The claw receiving portions 34 wherein the claw portions 31 of the locking levers and 23 are locked are disposed in right and left side portions of the circumferential wall 51. The holder 6 is mounted on the power supply portion 2 by a fastener member (a screw and the like) which is not shown in the figures. Incidentally, the other side member wherein the cover 5 is connected is not limited to the aforementioned holder 6, and can be variously modified provided that the other side member includes a structure in which at least the claw portions 31 can be locked. For example, a locking portion similar to the claw receiving portions 34 may be provided on an outer wall of the electrical appliance and the like.

Figure 5:
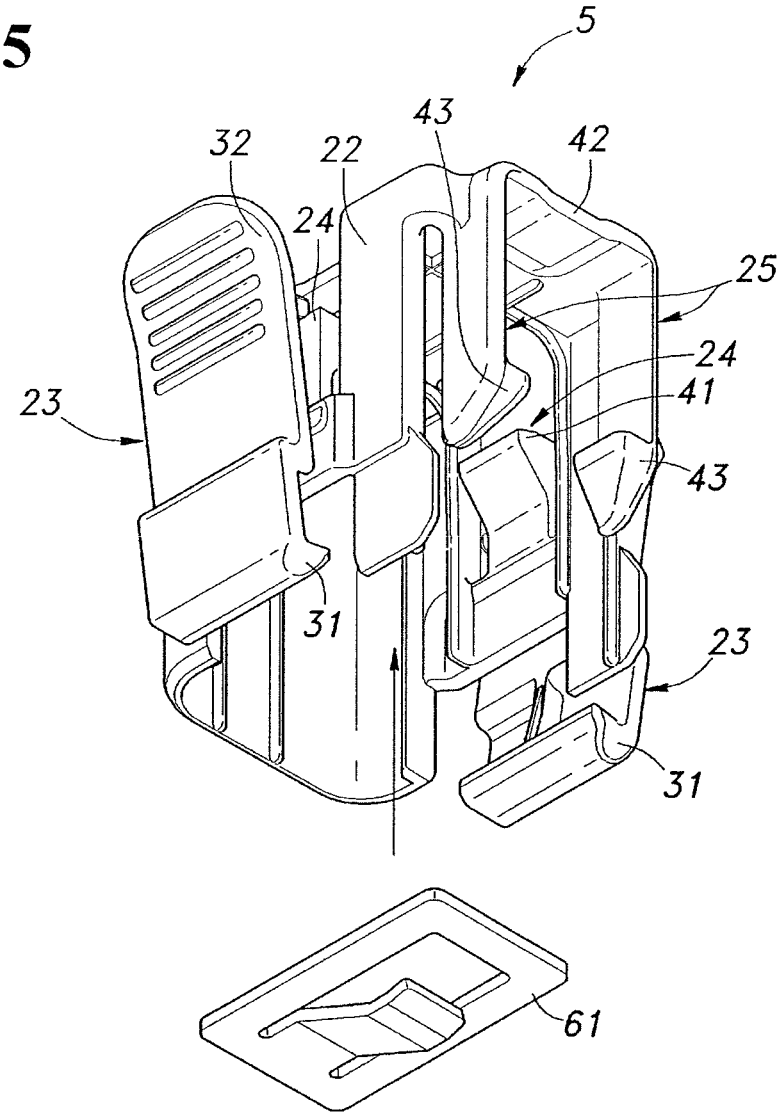
FIG. 5 is a perspective view showing the locking cover and a leaf spring attached to the locking cover.
Figure 6:
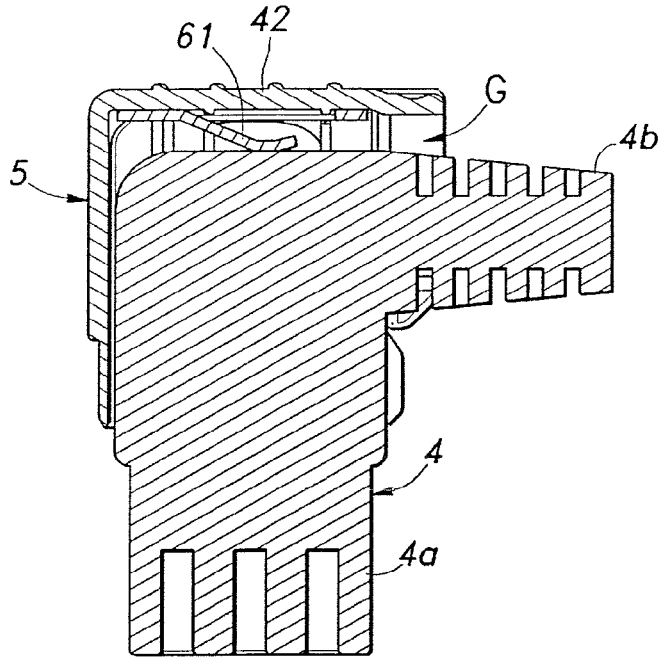
FIG. 6 is a cross-sectional view showing an attachment mode of the leaf spring relative to the locking cover.

As shown in FIG. 5, inside the upper wall 42 of the cover main body 21, there is mounted a leaf spring 61 as a fixing means for preventing the wobbling of the female socket 4. In the cord retaining apparatus 1 according to the present embodiment, even in a case wherein a size of the female socket 4 is different, as shown in FIG. 6, the wobbling of the female socket 4 can be prevented by interposing the leaf spring 61 in a gap G between the cover main body 21 and the female socket 4, and using an urging force thereof. Incidentally, as for the fixing means for preventing the wobbling of the female socket 4, the fixing means is not limited to the leaf spring 61, and can be rubber and the like having the similar elasticity.

Next, with reference to FIGS. 1, 4(A), and 4(B), main operation of the cord retaining apparatus 1 will be explained.

As shown in FIG. 1, the female socket 4 wherein the cover 5 is mounted is inserted into the opening of the holder 6, so that the female socket 4 and the male socket 7 are electrically connected, and also the cover 5 is connected to the holder 6 so as to come to a lock state shown in FIG. 4(A). At that time, the locking levers 23 and 23 of the cover 5 are in an engagement position, and the claw portions 31 come to a state of being locked in the claw receiving portions 34 of the holder 6.

Due to such lock structure, even in a case wherein a force acts in a direction of being separated from the male socket 7 relative to the female socket 4, the female socket 4 is prevented from being disengaged from the male socket 7. As a result, the connected state of the AC power-supply cord 3 relative to the power supply portion 2 is stably maintained. Also, due to such lock structure, there is the advantage of being capable of maintaining a high durability and a high lock force relative to repeated use.

On the other hand, when the connection between the cover 5 and the holder 6 is released, as shown in FIG. 4(B), a user turns the locking levers 23 and 23 in such a way as to pinch the knob portions 32 in the locking levers 23 and 23 of the cover 5 between the fingers so as to displace the connection between the cover 5 and the holder 6 to an engagement releasing position. Thereby, end sides of the locking levers 23 and 23 wherein the claw portions 31 are provided come to an expanded and open state so as to release the locking of the claw portions 31 relative to the claw receiving portions 34 of the holder 6. Also, at that time, back end sides of the locking levers 23 and 23 wherein the pressing projections 35 are provided move in a direction of the side walls 22, and outer surfaces of the locking walls 24 and 24 are pressed by the pressing projections 35. Thereby, the locking walls 24 and 24 come to a state wherein a displacement, in a direction (i.e., a direction wherein the locking claws 41 are disengaged from the grooves 11) wherein an engagement with the female socket 4 is released, is restricted.

Figure 7:
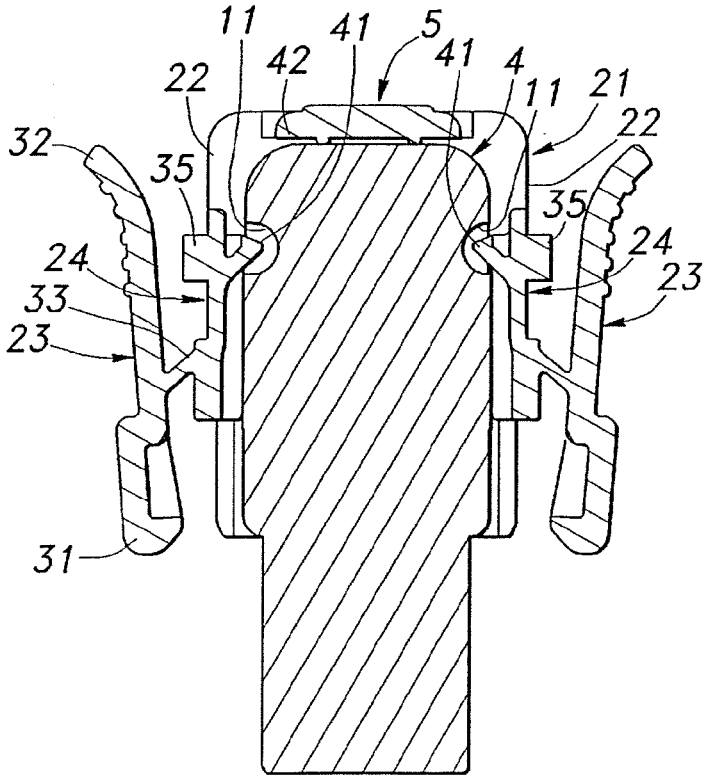
FIG. 7 is a cross-sectional view of essential parts showing a modified example of pressing projections of the locking cover according to the first embodiment.

Therefore, even in a case wherein a user strongly pulls the cover 5 in a direction shown by an arrow A from a state shown in FIG. 4(B), the cover 5 is prevented from disengaging from the female socket 4. In the locking levers 23 and 23, the pressing projections 35 abutting against the outer surfaces of the locking walls 24 and 24 are provided so as to be capable of pressing an intended portion in the locking walls 24 and 24 by an appropriate force. The pressing projections 35 are disposed corresponding to the locking claws 41 (i.e., disposed on back surface sides of the locking claws 41 clamping the locking walls 24 and 24) so as to be capable of allowing a pressing force thereof to act in a protruding direction of the locking claws 41. Incidentally, instead of the pressing projections 35 of the locking levers 23 and 23, as shown in FIG. 7, the similar pressing projections 35 can be provided on outer surface sides of the locking walls 24 and 24. Even in this case, the pressing projections 35 may be disposed corresponding to the locking claws 41. Also, the similar pressing projections may be provided in both the locking levers 23 and 23, and the locking walls 24 and 24.

<Second Embodiment>

Figure 8:
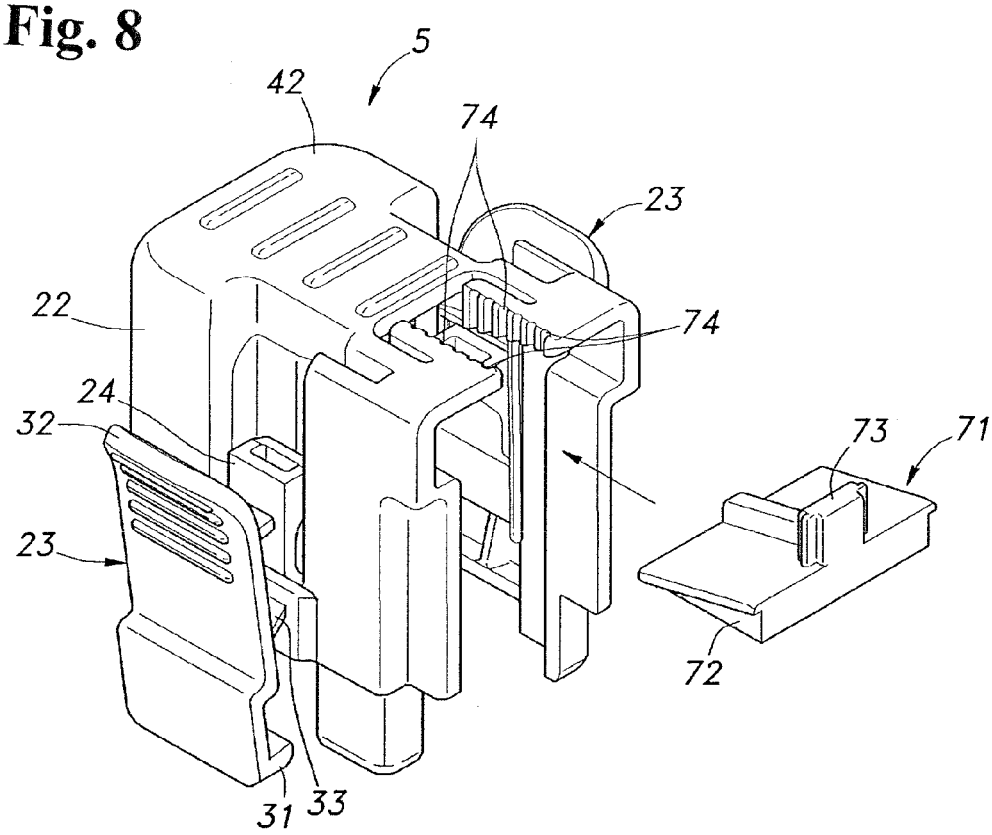
FIG. 8 is a perspective view showing the locking cover according to a second embodiment and a wedge-like member attached to the locking cover.
Figure 9:
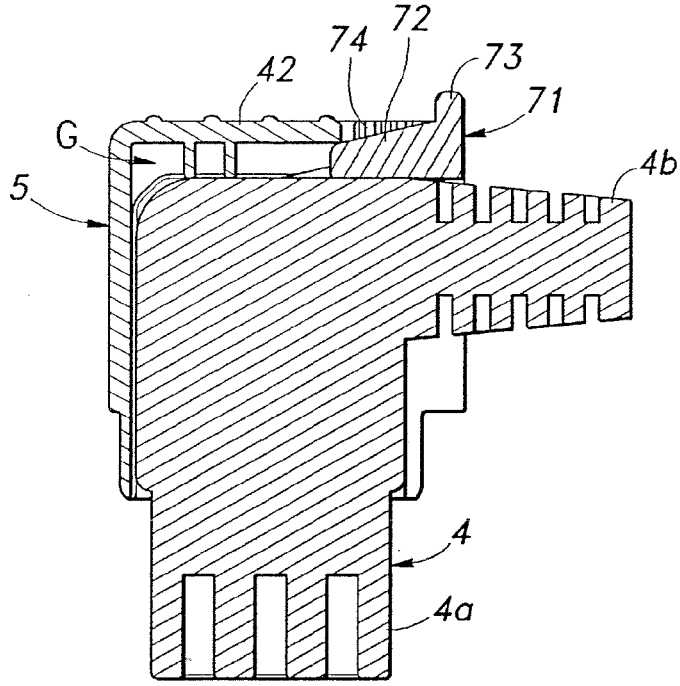
FIG. 9 is a cross-sectional view showing an attachment mode of the wedge-like member relative to the locking cover according to the second embodiment.
Figure 9:
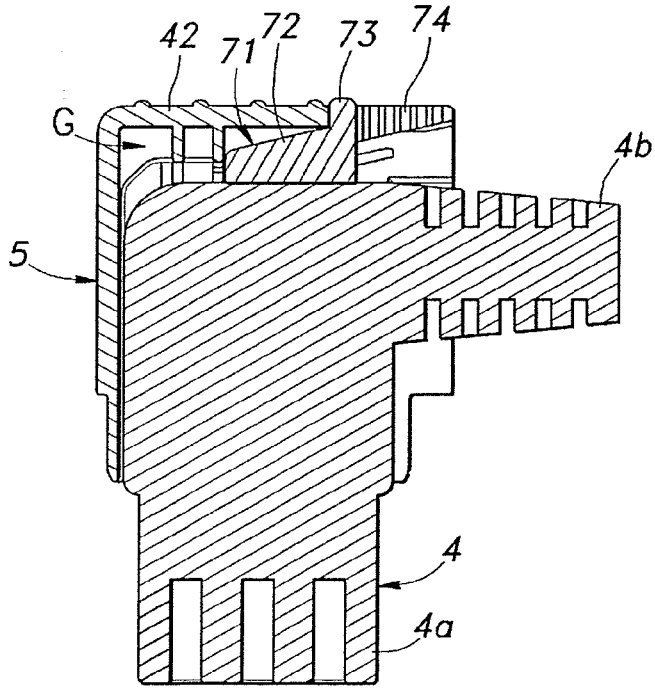

Next, with reference to FIGS. 8, 9(A), and 9(B), the cord retaining apparatus according to a second embodiment will be explained. In the second embodiment, a structure of the fixing means for preventing the wobbling of the female socket 4 differs from the case of the first embodiment. In FIGS. 8, 9(A), and 9(B), the same symbols are assigned to composition elements similar to the first embodiment. Also, regarding items similar to the first embodiment, detailed explanations are omitted except for the items particularly described hereinafter.

As shown in FIG. 8, inside the upper wall 42 of the cover main body 21, there is mounted a wedge-like member 71 as the fixing means for preventing the wobbling of the female socket 4. The wedge-like member 71 includes a wedge-shaped main body portion 72 which becomes gradually thicker toward a back end from a front end; and a guide piece 73 provided to protrude upward from the main body portion 72. Also, in a notch portion formed in a back portion of the upper wall 42 of the cover main body 21, there is provided to line up a plurality of guide grooves 74 wherein right and left side edges of the guide piece 73 can fit into.

As shown in FIGS. 9(A) and 9(B), the wedge-like member 71 can adjust an insertion depth into the gap G between the cover main body 21 and the female socket 4 by appropriately selecting a position of the guide grooves 74 wherein the guide piece 73 fits into. Due to such structure, an allowable range relative to the variability in the size of the female socket 4 increases so as to be capable of preventing the wobbling of the cover 5 and the female socket 4 further effectively.

Although the present invention is explained in the above in detail based on specific embodiments, the embodiments are absolutely illustrated as an example, and the present invention is not limited to the aforementioned embodiments. For example, the socket wherein the locking cover is mounted is not limited to the aforementioned L-shaped socket, and may be a socket with another shape (for example, a straight socket) provided that the socket includes at least the locking portion served for the locking of the locking cover 5. Also, the locking portion formed in the socket wherein the locking cover is mounted is not limited to the aforementioned grooves, and may have another shape (for example, a convex portion). In a case wherein the locking portion of the socket is the convex portion, a concave portion or an opening wherein the relevant convex portion is locked can be formed in the locking lever. Also, not all of each composition element of the locking cover for the electrical connecting appliance according to the present invention shown in the aforementioned embodiments are necessarily essential, and each composition element of the locking cover for the electrical connecting appliance according to the present invention can be selectively used provided that it does not exceed at least the scope of the present invention.

EXPLANATION OF SYMBOLS

1 a cord retaining apparatus
2 a power supply portion
3 an AC power-supply cord
4 a female socket (a second electrical connecting appliance)
5 a locking cover
6 a holder
7 a male socket (a first electrical connecting appliance)
11 grooves (second appliance side locking portions)
21 a cover main body
22 side walls
23 locking levers (first locking pieces)
24 locking walls (second locking pieces)
31 claw portions
32 knob portions
33 support pieces (hinge portions)
34 claw receiving portions (first appliance side locking portions)
35 pressing projections
41 locking claws
42 an upper wall
61 a leaf spring (an elastic member)
71 a wedge-like member

What is claimed is:

1. A locking cover for an electrical connecting appliance, adapted to mount on a second electrical connecting appliance connected to a first electrical connecting appliance for preventing a disconnection between the first electrical connecting appliance and the second electrical connecting appliance, comprising:

a cover main body externally fitted onto the second electrical connecting appliance;

first locking pieces formed on the cover main body, elastically engaging with first appliance side locking portions provided on a side of the first electrical connecting appliance, and releasing an elastic engagement by receiving an external force to be displaced to an engagement releasing position; and second locking pieces formed on the cover main body, and elastically disengageably engaging with second appliance side locking portions provided on a side of the second electrical connecting appliance, wherein the second locking pieces are pressed by the first locking pieces displaced to the engagement releasing position to restrict a displacement in a direction releasing an engagement with the second appliance side locking portions.

2. A locking cover for an electrical connecting appliance according to claim 1, wherein the first locking pieces are supported in hinge portions formed on side walls of the cover main body, and are displaced by the hinge portions as a supporting point, and the second locking pieces are formed as parts of the side walls facing the first locking pieces.

3. A locking cover for an electrical connecting appliance according to claim 1, wherein one of the first and the second locking pieces comprises pressing projections abutting against the other of the first and the second locking pieces when the first locking pieces are displaced to the engagement releasing position.

4. A locking cover for an electrical connecting appliance according to claim 1, further comprising a fixing device interposed in a gap between the cover main body and the second electrical connecting appliance.

5. A locking cover for an electrical connecting appliance according to claim 4, wherein the fixing device comprises an elastic member abutting against an inner surface of the cover main body and an outer surface of the second electrical connecting appliance.

6. A locking cover for an electrical connecting appliance according to claim 4, wherein the fixing device comprises a wedge-like member abutting against an inner surface of the cover main body and an outer surface of the second electrical connecting appliance, and capable of changing an abutting position thereof.

* * * * *